US005700533A

United States Patent [19]

You

[11] Patent Number: 5,700,533

[45] Date of Patent: Dec. 23, 1997

[54] FIBER BRAID MATERIAL

[76] Inventor: Chin-San You, No. 6, Lane 477, Sec. 2, Feng-Shyn Rd., Feng Yuan City, Taichung Hsien, Taiwan

[21] Appl. No.: 539,350

[22] Filed: Oct. 5, 1995

[51] Int. Cl.[6] ..... D04C 1/00

[52] U.S. Cl. ..... 428/36.3; 428/36.9; 87/8

[58] Field of Search ..... 428/36.1, 36.3, 428/36.9, 36.91; 87/8

[56] References Cited

U.S. PATENT DOCUMENTS 5,421,128 6/1995 Sharpless et al. ..... 52/2.13

*Primary Examiner*—Christopher Raimund

*Attorney, Agent, or Firm*—Browdy and Neimark

[57] ABSTRACT

The invention is directed to a fiber braid having at least a first fiber extending spirally along an imaginary axis such that the first fiber forms a predetermined angle with the imaginary axis and at least a second fiber interlaced with the first fiber and extending spirally and coaxially with the first fiber such that the second fiber and the first fiber form a tubular network, with the imaginary axis serving as the axis. At least a third fiber is added to the tubular network so that it extends in a direction parallel to the axis of the tubular network, and is interlaced through a selected number of openings in the tubular network.

2 Claims, 5 Drawing Sheets

FIBER BRAID MATERIAL

FIELD OF THE INVENTION

The present invention relates generally to a reinforced fiber braid, and more particularly to a reinforced fiber fabric braid which is made of a plurality of fibers interlaced multidirectionally and is suitable for use in making a tubular article.

BACKGROUND OF THE INVENTION

The fiber fabric materials, such as quartz fiber fabric material, carbon fiber fabric material, glass fiber fabric material, etc., are commonly used in making tubular components of bicycles, golf clubs, hockey sticks, billiard cues, fishing rods, tennis rackets, squash rackets, badminton rackets and so forth.

As illustrated in FIG. 1, a prior art fiber fabric material 30 is made of two sets of fibers 32. Each of the two sets is composed of a number of fibers 32 which are arranged at intervals and are parallel to one another. The two sets of fibers are different in direction in which they extend to form therebetween an angle $\alpha$. Before the fiber fabric material 30 is used to make a tubular article, the fiber fabric material 30 is impregnated with resin to form a platelike material and is then rolled manually in a direction parallel to a dividing line 34 which divides the angle $\alpha$ into two equal parts. The tubular material so formed is then heated under pressure to take form in a molding tool.

Both ends 36 of the fiber fabric material 30 are weaker in structural strength than other parts of the fiber material 30. For this reason, the fiber material 30 having a greater width is often used to compensate the structural weakness caused by both ends 36 of the fiber fabric material 30. However, there are disadvantages in using a wider fiber fabric material 30 to make a tubular article. Such disadvantages are described hereinafter.

The tubular article made of the wider fiber fabric material 30 is not uniform in structural strength. In other words, the tubular article has a wall which is uneven in thickness in view of the fact that fibers 32 of both ends 36 of the fiber fabric material 30 are overlapped to form a thicker wall. In addition, the overlapping of the fibers 32 of both ends 36 of the fiber fabric material 30 undermines the esthetic effect of the tubular article made of such fiber fabric material 30. Moreover, the overlapping of the fibers 32 of both ends 36 of the fiber fabric material 30 is responsible for an increase in the material cost.

Another prior art fiber fabric material 40 is shown in FIG. 2. The fiber fabric material 40 is made of two sets of fibers 42 which are interlaced such that they form therebetween an angle $\beta$. The tubular structure so formed of the fiber fabric material 40 has an axis parallel to a dividing line 44 which divides the angle $\beta$ into two equal parts. The fiber fabric material 40 is intended to overcome the shortcomings of the prior art fiber fabric material 30 illustrated in FIG. 1.

In view of the fact that the tubular articles made of the fiber fabric materials 30 and 40 are provided with an inadequate flexure strength, the fiber fabric materials 30 and 40 are therefore provided respectively with reinforcing layers 38 and 48, as shown in FIGS. 1 and 2. The reinforcing layers 38 and 48 are provided such that the fibers 32 and 42 of the reinforcing layers 38 and 48 are arranged respectively in a direction parallel to the longitudinal axes of the fiber fabric materials 30 and 40 forming the tubular articles.

The addition of the reinforcing layer 38 or 48 is not effective in overcoming the shortcomings of the fiber fabric material 30 or 40. This is due to the fact that the reinforcing layer 38 or 48 is joined with the fiber fabric material 30 or 40 only after the fiber fabric material 30 or 40 is rolled to have a tubular shape. It is therefore readily apparent that the addition of the reinforcing layer is not cost-effective, and that the addition of the reinforcing layer undermines the aesthetic effect of the tubular article so made.

SUMMARY OF THE INVENTION

It is therefore the primary objective of the present invention to provide a fiber fabric material capable of overcoming the shortcomings of the prior art fiber materials described above.

In keeping with the principle of the present invention, the foregoing objective of the present invention is attained by a fiber fabric material which is made of at least a first fiber, a second fiber and a third fiber. The fibers are interlaced such that the first fiber is extended spirally along an imaginary axis. The second fiber is extended spirally such that the second fiber and the first fiber form therebetween a predetermined angle, and that the second fiber is interlaced with the first fiber to form a tubular network. The third fiber is interlaced with the first fiber and the second fiber such that the third fiber is parallel to the axis of the tubular network, and that the third fiber is united with the tubular network by passing through a predetermined number of meshes or openings of the tubular network.

DETAILED DESCRIPTION OF THE INVENTION

Figure 1:
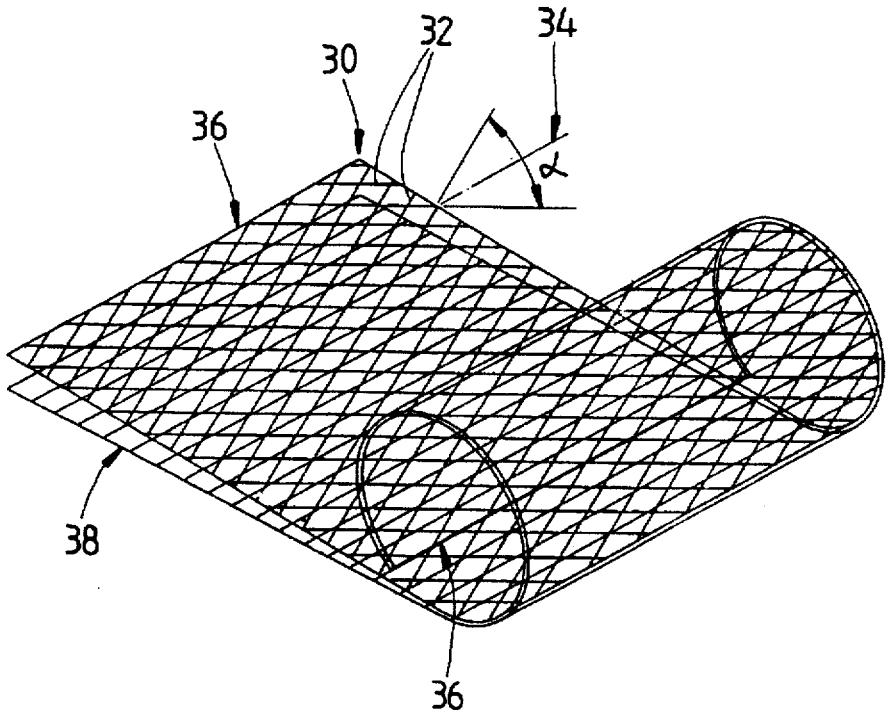
FIG. 1 PRIOR ART
FIG. 1 shows a perspective schematic view of a prior art fiber fabric material.
Figure 2:
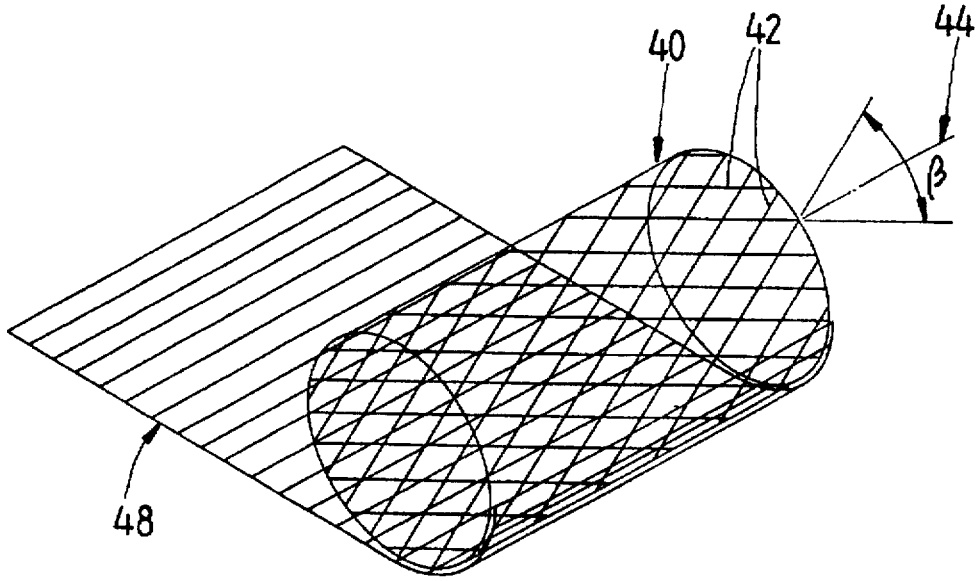
FIG. 2 PRIOR ART
FIG. 2 shows a perspective schematic view of another prior art fiber fabric material.
Figure 3:
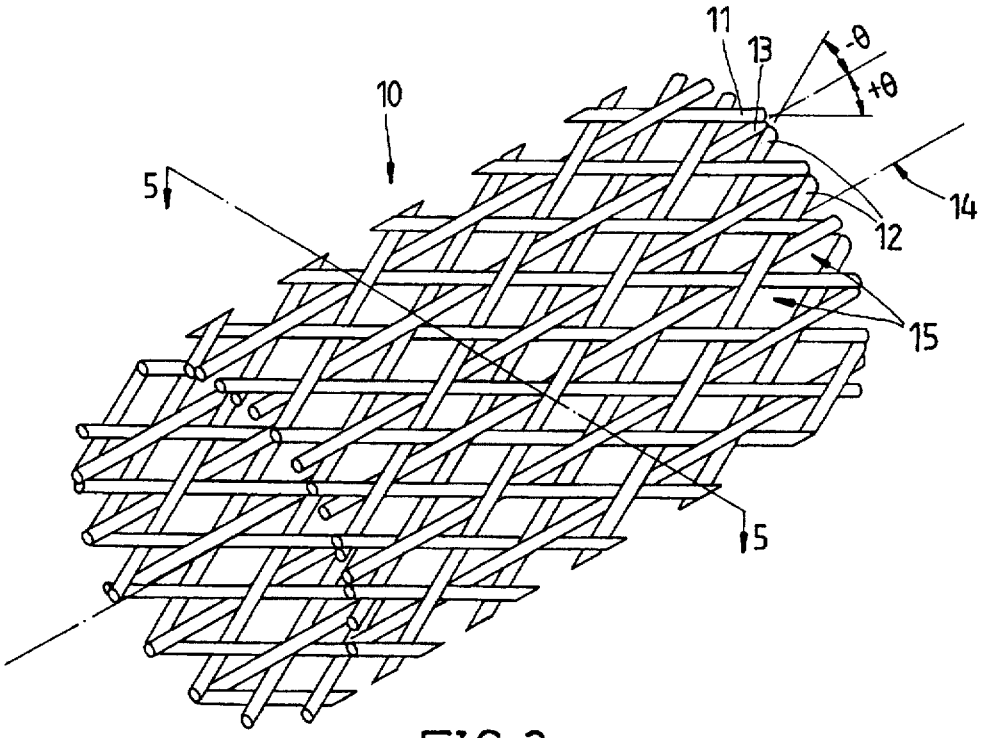
FIG. 3 shows a perspective schematic view of a first preferred embodiment of the present invention.
Figure 4:
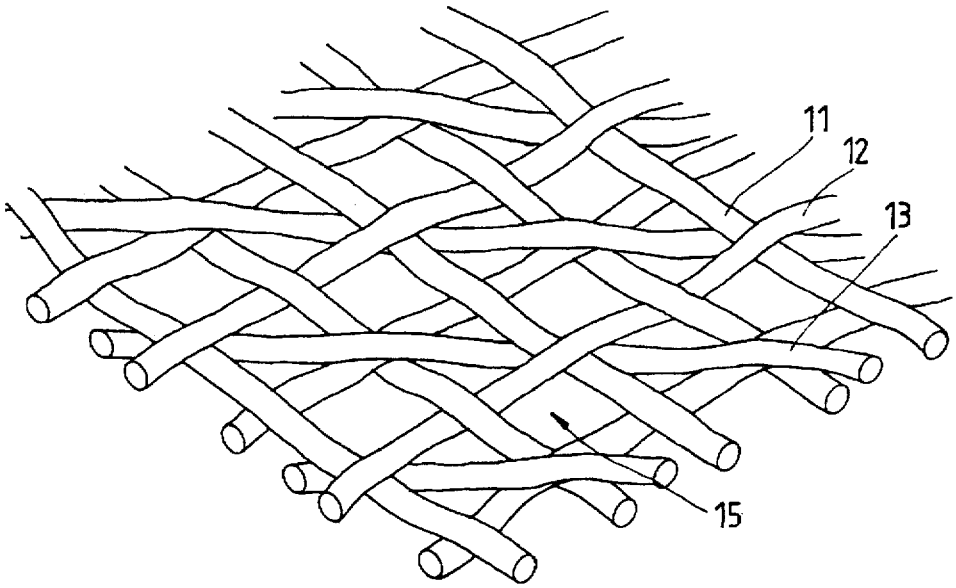
FIG. 4 shows a partial enlarged view of the first preferred embodiment of the present invention.
Figure 5:
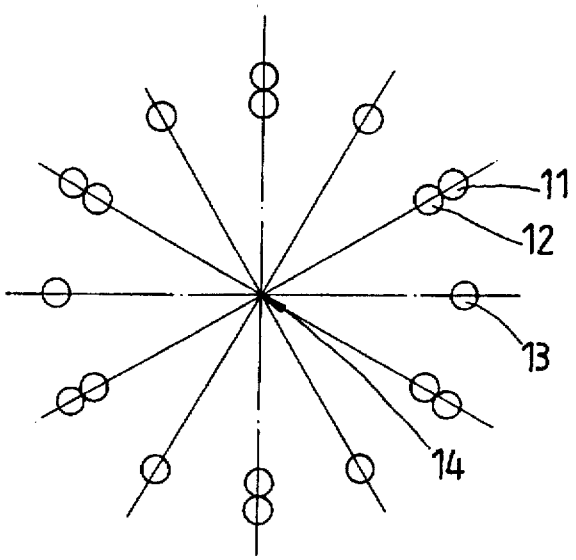
FIG. 5 shows a sectional view of a portion taken along the direction indicated by a line 5—5 as shown in FIG. 3.

As shown in FIGS. 3–5, a fiber fabric material 10 of the first preferred embodiment of the present invention is composed of a number of first fibers 11, second fibers 12 and third fibers 13, which are interlaced multidirectionally.

The first fibers 11 are arranged at a predetermined interval, with each of the first fibers 11 being extended spirally to form a first spiral angle θ with an imaginary axis 14.

The second fibers 12 are arranged at a predetermined interval such that the second fibers 12 are extended respectively and spirally to form a second spiral angle −θ with the imaginary axis 14. The second fibers 12 and the first fibers 11 are interlaced to form a tubular network having a number of meshes or openings 15.

The third fibers 13 are united with the tubular network such that the third fibers 13 are parallel to the imaginary axis 14, and that the longitudinal axis of each of the third fibers 13 is corresponding in location to a line which divides the sum of the first spiral angle +θ and the second spiral angle −θ into two equal parts, and further that the third fibers 13 pass through the meshes or openings 15 which are arranged along the direction of the longitudinal axis of the tubular network.

It is therefore readily apparent that the fiber fabric material 10 of the present invention is relatively cost-effective in view of the fact that the fiber fabric material 10 is devoid of a reinforcing layer which can complicate the process of making a tubular article. In addition, the tubular article made of the fiber fabric material 10 of the present invention is provided with a wall that is uniform in thickness and flexure strength. Moreover, the tubular article made of the fiber fabric material 10 of the present invention is esthetically superior to the tubular article made of the prior art fiber fabric materials. A technical advantage of the fiber fabric material 10 of the present invention must be emphasized here. The flexure strength of the fiber fabric material 10 of the present invention can be easily enhanced by increasing the number of the third fibers 13 and by passing each of the third fibers 13 through each of the meshes 15. In other words, the third fibers 13 can be interlaced with the first fibers 11 and the second fibers 12 such that the third fibers 13 bypass some of the meshes 15.

Figure 6:
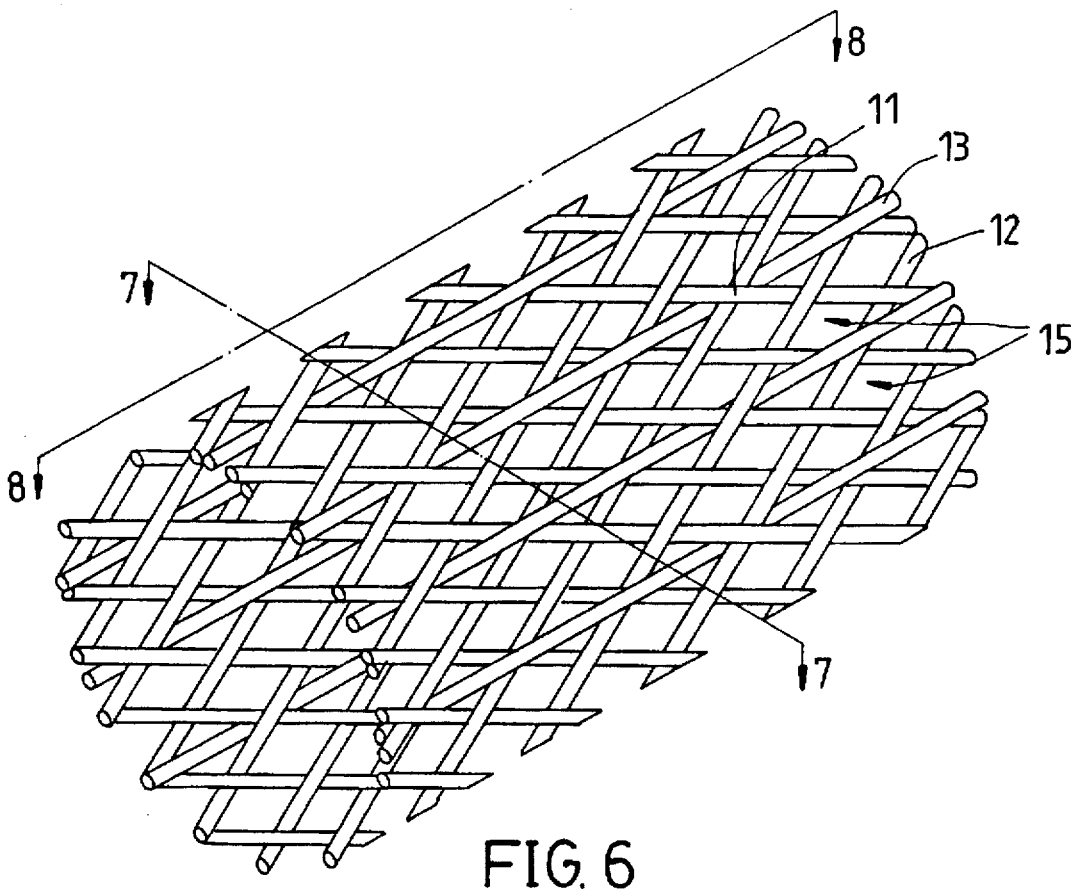
FIG. 6 shows a perspective schematic view of a second preferred embodiment of the present invention.
Figure 7:
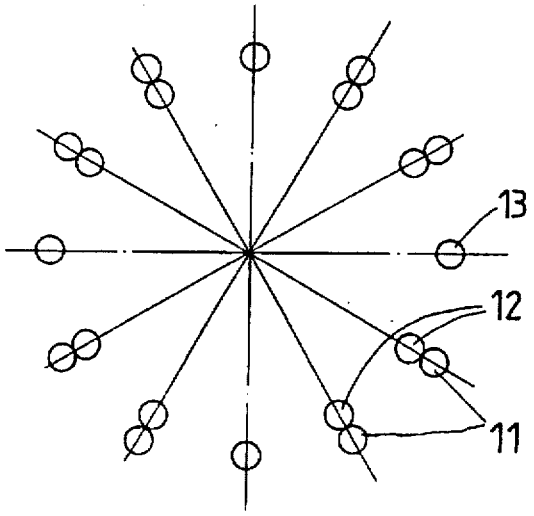
FIG. 7 shows a sectional view of a portion taken along the direction indicated by a line 7—7 as shown in FIG. 6.
Figure 8:
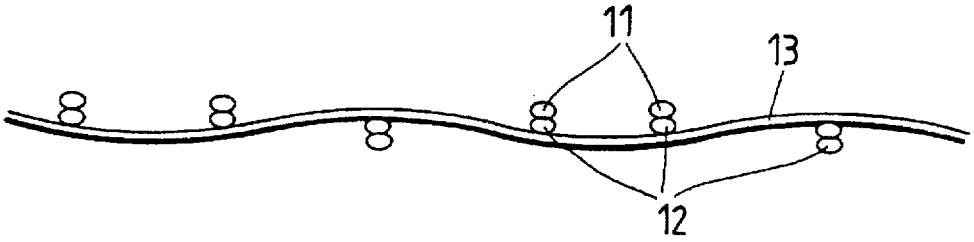
FIG. 8 is a sectional schematic view of a portion taken along the direction indicated by a line 8—8 as shown in FIG. 6 for showing the way by which the third fiber is arranged.

As shown in FIGS. 6–8, the fiber fabric material of the second preferred embodiment of the present invention is different from the fiber fabric material of the first preferred embodiment of the present invention in that the former is provided with a number of third fibers 13 which are interlaced with the first and the second fibers 11 and 12 in such a manner that two adjoining third fibers 13 are separated by two meshes or openings 15 and that the third fibers 13 bypass two meshes or openings 15 before passing through one mesh 15.

Figure 9:
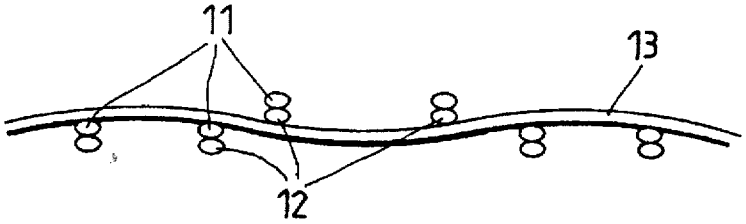
FIG. 9 is a sectional schematic view taken along the direction of the longitudinal axis of a third preferred embodiment of the present invention for showing the way by which the third fiber is arranged.

As shown in FIG. 9, the fiber fabric material of the third preferred embodiment of the present invention is composed of a number of the third fibers 13 which are interlaced with the first and the second fibers 11 and 12 in such a manner that the third fibers 13 bypass two meshes 15.

Figure 10:
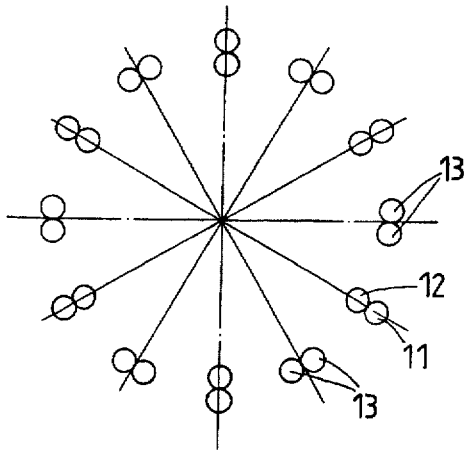
FIG. 10 is a sectional view taken at right angle to the longitudinal axis of a fourth preferred embodiment of the present invention.

As illustrated in FIG. 10, the fiber fabric material of the fourth preferred embodiment of the present invention consists of a number of third fibers 13 which are interlaced with the first and the second fibers 11 and 12 in such a manner that two of the third fibers 13 are put side by side through the same mesh or opening 15.

Figure 12:
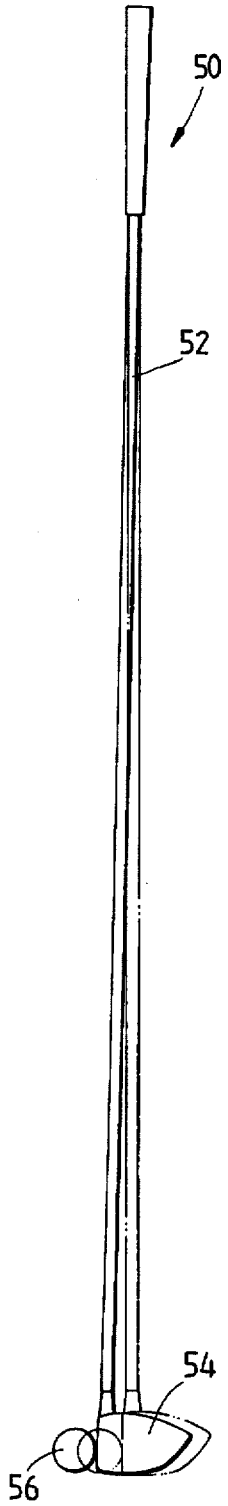
FIG. 12 is a front view illustrating the ball-striking action of a golf club made of the fiber fabric material of the present invention.
Figure 11:
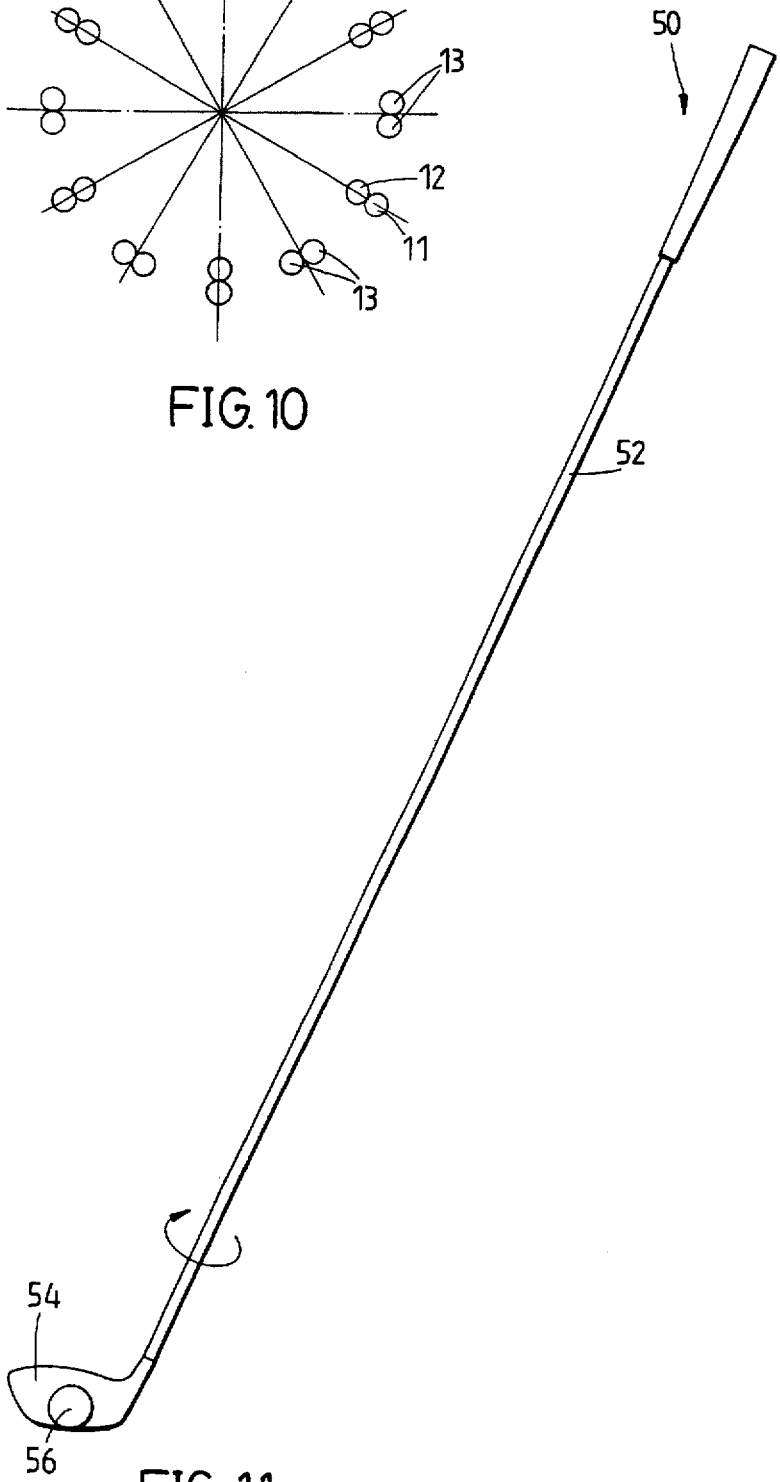
FIG. 11 is a side view illustrating the ball-striking action of a golf club made of the fiber fabric material of the present invention.

The relationship between the torsion strength and the flexure strength of a golf culb 50 made from the fiber fabric material 10 of the present invention is illustrated in FIGS. 11 and 12. The golf club 50 has a shaft 52 and a head which is fastened with the shaft 52 and is provided with a ball-striking portion 54. When the shaft 52 is swung such that the ball-striking portion 54 hits a golf ball 56, the ball-striking portion 54 is exerted on by a reaction force of the golf ball 56. As a result, a torsional moment indicated by an arrow in FIG. 11 is brought about on the shaft 52. The first and the second fibers 11 and 12 of the fiber fabric material 10 serve to prevent the shaft 52 from breaking. In the meantime, the ball-striking portion 54 brings about a flexure moment of force on the shaft 52 by memos of the top end of the golf club 50 serving as a fulcrum. The third fibers 13 of the fiber fabric material 10 serve to prevent the shaft 52 from breaking. In other words, the structural strength of the golf club 50 is effectively enhanced by the third fibers 13 of the fiber fabric material 10 from which the golf club 50 is made.

What is claimed is:

1. A fiber braid comprising:

at least a first fiber extending spirally along an imaginary axis such that said first fiber forms an angle with said imaginary axis;

at least a second fiber interlaced with said first fiber and extending spirally and coaxially with said first fiber such that said second fiber and said first fiber form a tubular network, with said imaginary axis serving as an axis of said tubular network, said tubular network comprising openings formed by interlacing the first fiber and the second fiber; and at least a third fiber which is oriented in a direction parallel to said axis of said tubular network, wherein said third fiber is interlaced through the openings in said tubular network;

wherein said tubular network is united with a plurality of third fibers which are interlaced with said first fiber and said second fiber such that each said third fiber of said plurality of fibers is interlaced in the openings in the same manner as another said third fiber on an opposite side of said axis of said tubular network.

2. The fiber braid as defined in claim 1, wherein said third fiber is interlaced with said first fiber and said second fiber so as to bypass one or more of said openings.

* * * * *